United States Patent [19]

Allen

[11] Patent Number: 4,697,719

[45] Date of Patent: Oct. 6, 1987

[54] FOIL-LID COMBINATION FOR CONTAINERS

[75] Inventor: David O. Allen, Wilmington, Ohio

[73] Assignee: Allen Tool Company, Inc., Wilmington, Ohio

[21] Appl. No.: 926,566

[22] Filed: Nov. 3, 1986

[51] Int. Cl.[4] ..... B65D 51/22

[52] U.S. Cl. ..... 220/258; 220/359; 229/102; 229/125.25; 215/232

[58] Field of Search ..... 220/258, 260, 270, 359, 220/306; 215/232, 254, 257; 229/43 R

[56] References Cited

U.S. PATENT DOCUMENTS

| | | | |
|---|---|---|---|
| 3,904,074 | 9/1975 | Hoffman et al. | 220/258 |
| 4,358,025 | 11/1982 | Urion | 220/258 |
| 4,448,345 | 5/1984 | Helms | 229/43 |
| 4,501,371 | 2/1985 | Smalley | 220/258 |

*Primary Examiner*—George T. Hall
*Attorney, Agent, or Firm*—Becker & Becker

[57] ABSTRACT

A closure or plastic lid having a substantially circular configuration as well as an outer annular periphery is provided with concentrically located projection ribs on one side thereof as well as an outer skirt portion and an inner skirt portion extending axially in an opposite direction from a periphery of the plastic lid or closure in a location radially outwardly of the rib projections which assure a broad area of contact sealing engagement with respect to an arcuately curved bead portion of a container wall contacted both in an axial region and a radially outer region as to a foil membrane or liner having at least one, preferably three radially outwardly projecting tabs which are folded into a slot or recess concentrically between the outer skirt portion and inner skirt portion of the cover or lid.

15 Claims, 5 Drawing Figures

FOIL-LID COMBINATION FOR CONTAINERS

BACKGROUND OF THE INVENTION

1. Field of the Invention

The present invention relates to a foil-line closure lid for a container with a slit molded into the closure skirt to receive folded tabs of a foil liner.

2. Description of the Prior Art

There are many composite paper and aluminum foil containers on grocery shelves and in snack-shops or other marketing areas today that utilize a foil membrane to seal at least one end of a package or container. These containers, cans or packages have a rolled bead surrounding the mouth, the foil membrane being adhesively attached to the top of the bead. A plastic closure is usually provided to protect the foil membrane and to provide re-sealing means.

In some situations, the foil membrane is sealed directly to the top of the can or container, and the plastic closure or lid is applied in a second operation. The sealing is accomplished by activating a hot melt coating on the foil with heat inducing means, either via convection or induction. In other situations, the foil is inserted into the plastic closure or lid. The closure or lid is then applied to a rolled bead can or container and the assembly is passed under an induction coil to heat the metal foil and activate the hot melt coating to accomplish the seal in one step.

Although the last method described is desirable in several aspects thereof, there must be noted that inherent problems are encountered as follows:

(1) It is difficult to retain the thin foil membrane in a plastic closure during packing and shipping of the closures, and in application to the can or container;

(2) For package or container opening purposes, it is desireable that the foil membrane include a tab or projection that can be grasped with fingers so that the sealed membrane can be peeled from the mouth of the container neatly.

In a situation where the foil is applied prior to the plastic re-closure, it is possible to either form the tab downwardly along the container sidewall after the seal is accomplished, or to fold it back so that it lies underneath the closure panel. However, if it is desired to insert the foil into a closure prior to application thereof with respect to a container, it is necessary to fold the tab over prior to inserting the foil membrane into the closure so that the tab does not interfere with subsequent closure packaging and application operations. This creates a double thickness of foil, and problems can be encountered when trying to effect a heat seal to the rolled bead of a container; pressure must be applied to force the foil membrane to conform to the container bead, but it is difficult to generate enough pressure to guarantee a perfect seal at the points adjacent either side of the folded tab.

In the prior art there exists a U.S. Pat. No. 3,892,351—Johnson et al dated July 1, 1975 which discloses a closure with a multitude of finely pitched, radially spaced ribs in a top panel of the closure directly above the seal area. These ribs were intended to force a foil membrane to conform reliably to the container bead along points on either side of a folded tab. Also there exists a U.S. Pat. No. 3,973,719—Johnson et al dated Aug. 10, 1976 which is a division of the foregoing U.S. Pat. No. 3,892,351—Johnson et al and which relates to a container assembly and method involving induction heat sealing of a membrane-type closure. Still another division of the foregoing U.S. Pat. No. 3,892,351 is represented by U.S. Pat. No. 3,988,185—Johnson et al dated Oct. 26, 1976 which also relates to a container assembly and method employing induction heat sealing. Similarly, a U.S. Pat. No. 4,139,643—Hix et al dated Feb. 13, 1979 and a U.S. Pat. No. 4,164,588—Johnson dated Aug. 14, 1979 exist disclosing a snack food package and a package liner and fragile snack chip combination respectively related to a package liner of a type with which a foil-lid combination for containers according to the present disclosure can be utilized.

BRIEF DESCRIPTION OF THE DRAWINGS

This object and other objects and advantages of the present invention, will appear more clearly from the following specification in conjunction with the accompanying drawings, in which.

SUMMARY OF THE INVENTION

Figure 1:
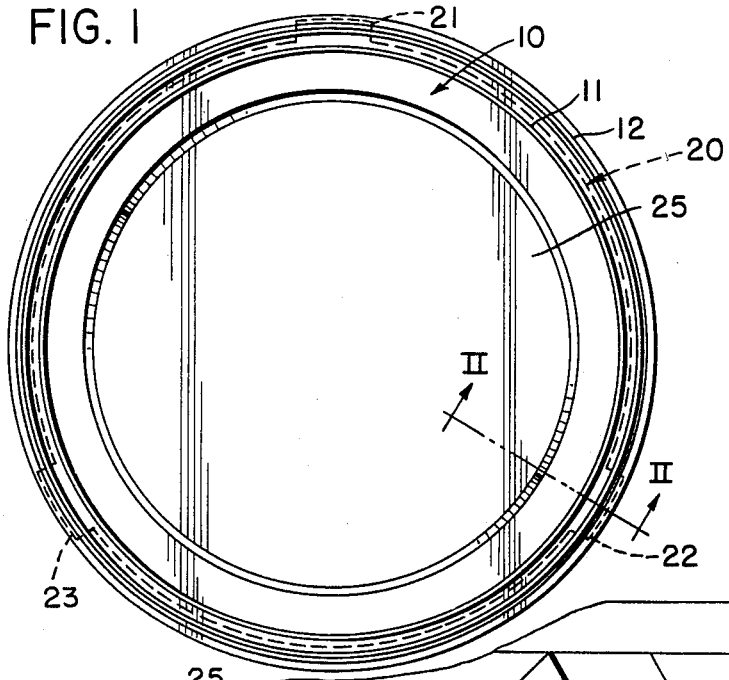
FIG. 1 is a top plan view of a foil-lid combination for containers and having features in accordance with the present invention.
Figure 3:
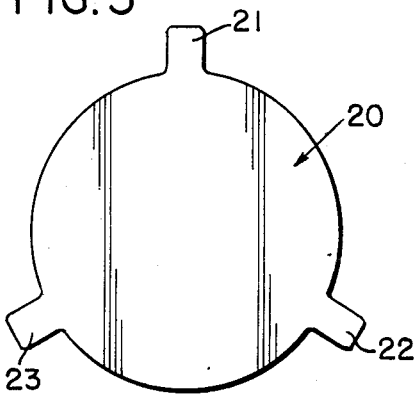
FIG. 3 is a plan view of a foil with tabs arranged in angular equal spacing relative to each other around outer periphery of the foil in a circular configuration.

An object of the present invention is to provide a foil-lid combination for containers with a dual-skirt foil-lined lid with which a slit formed between the dual-skirt configuration has tabs on a foil liner tucked into the slit for an originally-effective dual-skirt closure sealing subject to having the tabs on the foil liner provide a tamper-indicating sign that shows that the originally-effective dual-skirt closure sealing has been opened since the tabs will not re-engage the slit in the dual-skirt configuration of the closure or lid but will stick out at approximately right angles to the closure skirt indicating that the closure has been removed and replaced. Features of the present invention eliminate the sealing problems inherent to a folded tab by providing the slit in the dual-skirt configuration of the plastic closure or lid to receive the tab or tabs of a foil liner so that there is no double thickness of foil in the seal area, or projection of the tab from the closure that would interfere with closure packaging and application. Also, when the tab or tabs of the foil liner are inserted into the slit in the closure skirt, the foil is retained in the closure in a positive manner; three tabs located at 120°-angular spacing from each other ensure a good liner retention with respect to the top edge or end periphery of a lid for the container or package. Furthermore there can be noted that previously known so-called easy-open aluminum ends used with snack or food packaging previously can be replaced with a foil-line plastic closure or lid applied to a roll bead can, container or package. The foil liner has at least one tab that is folded over prior to inserting the liner into the closure; the lined closure or lid is subsequently applied to the can and sealed by induction means at high production rates. There has been found that a foil liner inserted into a dual-skirt closure or lid in accordance with the present inventive disclosure can overcome the following problems encountered with previous closure systems, such problems including the following:

(A) The foil liner in the previous closure sometimes came out during handling and application to the cans or containers;

(B) Leaks in the seal at points adjacent to such a folded tab also can result in of a sealing problem.

A further object of the present invention is to provide a broad area of contact for sealing not only composite paper/aluminum foil cans with a rolled bead as well as an equally important applicability on plastic tubs and cans, such as margarine and yogurt tubs, and also cake-frosting and shortening cans or containers.

DESCRIPTION OF PREFERRED EMBODIMENT

Referring now to the drawings in detail, FIGS. 1–4 inclusive show features of a foil-lid combination for containers including a closure, cover or lid 10 suitably made of plastic such as low-density polyethylene, linear polyethylene or other suitable moldable plastic material including upwardly extending double ribs, rings or circular projections 11 and 12 which serve as means for creating a broad area of contact during sealing application of the closure or lid 10 with respect to a container wall 13 having an outwardly bent or curved bead 14 integral therewith and bent downwardly over a top edge of a container label or outer covering 15.

The foil-lid combination for the containers in accordance with the present invention includes a foil membrane or liner 20 having at least one, preferably three radially outwardly projecting tabs or projections 21, 22 and 23 respectively integral with an outer peripheral edge of the foil membrane or liner 20. The closure or lid 10 includes integrally therewith a dual-skirt configuration having an outwardly located and cylindrically extending outer skirt portion 28 and a further radially inwardly located skirt portion 29 defining a slit or recess concentrically therebetween. The inwardly located skirt portion 29 has a radially inwardly projecting and tapered, substantially triangular-shaped rib or radially inwardly extending projection or vertex 31 against which outer periphery 32 of the foil membrane or liner 20 engages and is pressed in sealing engagement via a hot-melt adhesive coating 26 on the underside of the foil membrane serving to bond the foil membrane or liner 20 with respect to the curved or arcuate bead 14 along a peripheral end of the container wall 13. In accordance with the illustration of the fragmentary sectional elevational view of FIG. 2 there is noted that the radially outwardly projecting tab 22 for example is tucked into the slit 30 neatly to fit in annular space between the inner skirt portion 29 having a smooth outer surface configuration and the outer skirt portion 28 having an inner smooth configuration. Once the container closure or lid 10 has been removed from the bead portion 14 of the container wall 13 for access to the snack or food product or even a beverage held in the container, the flexing of the inner skirt portion 29 when the radially inwardly extending projection 31 passes over the laterally outer periphery of the bead 14 of the container wall 13, the tab projection 22 is distorted out of the slit 30 in any random direction and upon replacement of the lid, such tab projection 22 remains projecting substantially at right angles radially outwardly as a tamper-indicating sign that the originally-effective dual-skirt closure sealing has been opened since the tabs 21, 22, 23 will not re-engage in the annular slit between the outer skirt portion 28 and the inner skirt portion 29 of the dual-skirt closure or lid such that the tabs will project or stick out at approximately right angles to the closure skirt indicating that the closure has been removed and/or replaced with respect to the outwardly curved bead portion 14 of the container wall 13. The tabs during original assembly thereof prior to mounting of the closure or lid 10 with respect to the open end of a container wall 13 in sealing engagement axially and radially laterally of the bead portion 14 of the container wall 13 will allow an original sealing engagement and mounting of the cover or lid 10 as to the container bead portion 14 and container wall 13.

Figure 2:
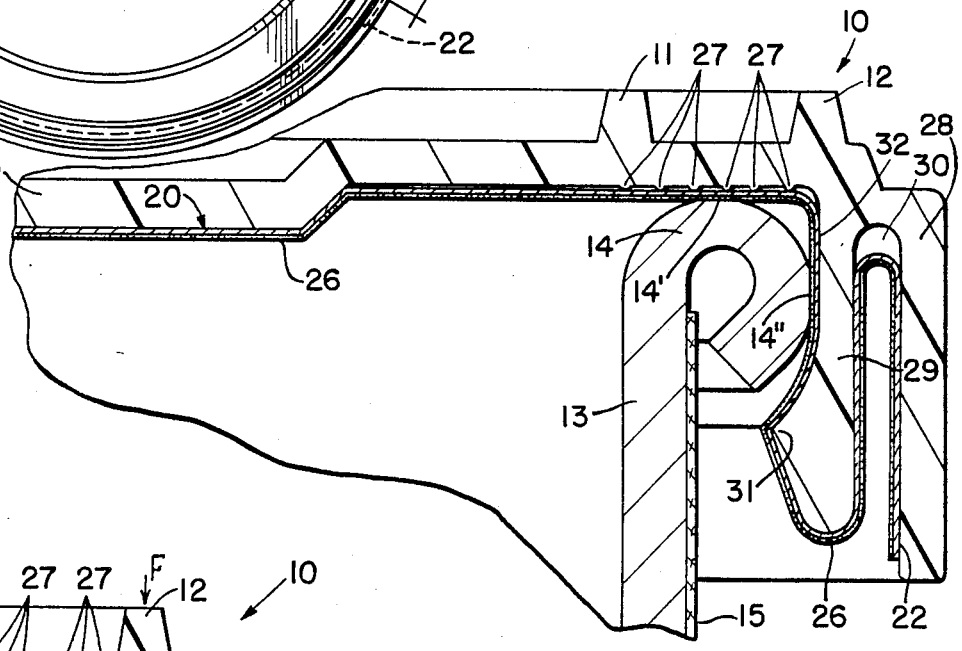
FIG. 2 is an enlarged fragmentary elevational sectional view taken along line II—II in FIG. 1.
Figure 4:
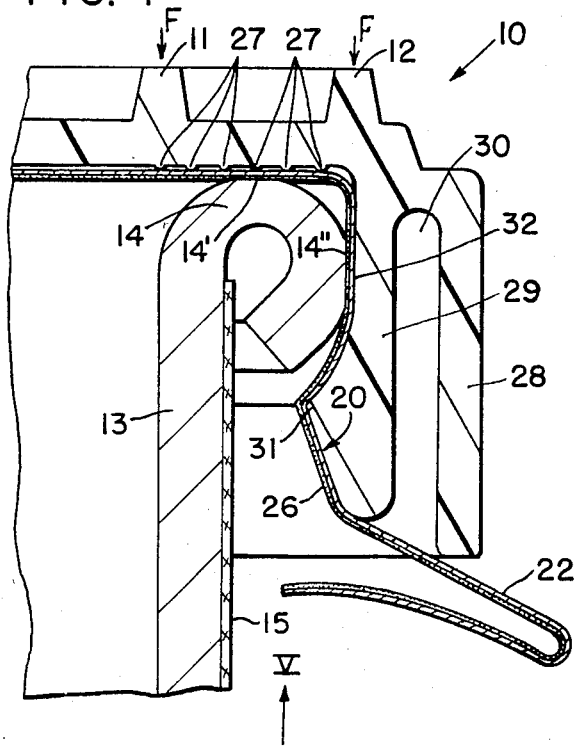
FIG. 4 is a fragmentary sectional view similar to that of FIG. 2 and having foil tabs located after removal of the foil-lid combination for containers from original sealing relationship between dual-skirt configuration of the closure or lid such that a tamper-indicating sign is provided with the tabs projecting visibly out of the slits or grooves between the dual-skirt configuration.
Figure 5:
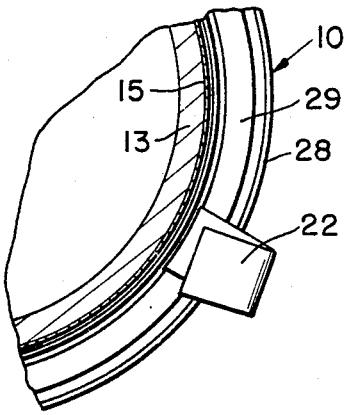
FIG. 5 is a fragmentary segmental view taken in the direction of arrow V in FIG. 4.

The foil membrane or liner 20 has a hot melt adhesive coating on one side only and the sectional views of FIGS. 2 and 4 show the closure with the liner in place, sealed to a composite foil-lined can or container with the lid engaged as originally sealed and then after removing and replacing the lid thereof with respect to the rolled bead 14 at the mouth or open end of the cylindrical container wall 13. The foil tabs 21, 22 and 23 are bent up and fitted snugly and tightly into the groove or slit 30 formed between the dual-skirt portions 28–29 of the cover or closure lid 10. The outer diameter of the foil membrane or liner itself is substantially the same as the outer diameter of the container as to the axial and radially laterally outwardly located arcuate areas 14' and 14'' of the bead 14. With force in the direction of arrows F being applied to the double rings or projections 11–12 located radially inwardly and radially outwardly respectively though axially spaced as to the axial engagement location 14' of the bead 14 that portion of the closure panel surface between the rings 11–12 will be caused to conform to the shape of the top of bead 14 thereby providing a broad area of sealing contact between the foil membrane 20 and the container bead 14. A proper resealing of the closure lid as to the lid-bead areas or regions 14' and tab-projection area(s) 14'' can be attained for storage purposes but subject to the tab projections 21, 22, 23 are then removed from the snugly-fitting and tucked-in relationship between the outer skirt portion 28 and inner skirt portion 29.

The present invention eliminates any sealing problems inherent with a folded tab by providing the slit 30 between the radially outer skirt portion 28 and radially inner skirt portion 29 concentrically spaced with respect to each other and projecting axially to one side and parallel to each other as well as integrally with an outer periphery of the plastic closure or lid 10 to receive the tab or tabs of the foil liner 20 so that there is no double thickness of foil in the seal area, or projection of the tab from the closure that would interfere with closure packaging and application. Also when the tab or tabs 21, 22, 23 of the foil liner 20 are inserted into the slit 30 in the dual-skirt closure configuration between the outer skirt portion 28 and inner skirt portion 29, the foil 20 is retained in the closure in a positive manner; three tabs 21, 22, and 23 are at least considered advisable to insure good liner retention.

The following advantages can be noted with respect to the features of the present invention:

(I) The present inventive foil-lid combination for containers has a wider induction sealing window via the hot melt adhesive coating 26; due to the absence of a folded tab in the sealing area between the foil membrane or liner 20 and the bead of the container, there could be overcome evidently the problems in induction sealing encountered when double thickness of foil was previously attempted to be employed;

(II) The foil or membrane liner 20 is held in the underside location of the lid or closure 10 in a much more secure relationship mechanically due to the engagement of the tabs 21, 22 and 23 into the slit 30;

(III) The dual ring projections 11, 12 on the top of the closure or lid 10 provide better pressure distribution to create a wider contact in the sealing area axially with respect to the region 14' of the bead 14; and (IV) The three tabs or projections 21, 22, 23 aid in the handling of the foil membrane or liner 20 during the closure lining process and installation prior to snap fit of the closure or cover lid 10 with respect to the bead regions 14' and 14'' of the outwardly curved bead 14 at the cylindrical end of a container wall 13.

The foil-lined dual-skirt closure having features in combination in accordance with the present invention avoids problems previously encountered when a foil liner attempted to be used came out during handling and application as to the cylindrically open ends of cans or containers; also the leaks in the seal previously encountered at points adjacent to the folded tab were considered to be somewhat of a problem no longer encountered with the arrangement of the present invention.

The ribs or ridges 27 are located concentrically rather than radially in an area of overlap of the plastic lid or closure 10 and the foil membrane or liner 20 especially axially of the bead region 14' of the bead 14 integral with the container wall 13. The tab-projecting interfit with respect to lid dual-skirt configuration should be considered applicable to oval container openings or windows equally as well as round or circular configuration.

Also, there is noted that the liner or membrane can be made of metallic foil such as aluminum or other metal or alloys thereof as well as non-metallic foil of various types of paper (craft paper or treated paper as used with instant coffee jars), plastic (Saran, Mylar, polyethylene glascene) or laminates thereof. Sealing can be accomplished by heat, by induction or by rolling of adhesive coated on one side of the foil or along the bead of the container.

The present invention is, of course, in no way restricted to the specific disclosure of the specification and drawings, but also encompasses any modifications within the scope of the appended claims.

What I claim is:

1. A foil-lid arrangement for containers including a cylindrical wall configuration and an open end thereof surrounded by an outwardly curved bead surface for packing of food including snacks, chips, bread crumbs as well as plastic tubs and cans, such as margarine and yogurt tubs, and cake frosting and shortening cans to be provided with a sealing closure, comprising:

a lid body of plastic having an outer periphery projecting outwardly over the bead surface;

dual skirt means including an outer skirt portion and an inner skirt portion spaced and extending axially from said outer periphery of said lid body and having a slit space formed therebetween open only in a direction away from said outer periphery; and a foil-membrane liner inserted into said lid body and including an outer periphery and at least one outwardly projecting tab joined to said outer periphery of said liner, said projecting tabs being tucked into said slit space prior to installation of said circular lid body including said inner skirt portion in engagement with said bead surface such that said foil-membrane liner is maintained together with said lid body including said projecting tabs inserted snugly in the slit space between said outer and inner skirt portions, said projecting tabs however also providing a tamper-indicating sign if said lid body is removed from said bead surface prematurely since said projecting tabs do not re-engage the slit between outer and inner skirt portions upon replacing said lid body relative to the container bead surface but rather said projecting tabs stick out below said outer and inner skirt portions indicating that said lid body has been removed and replaced.

2. A foil-lid arrangement according to claim 1 in which said outer periphery of said lid body includes double ribs spaced relative to each other and projecting axially therefrom in a direction opposite to that of said outer and inner skirt portions.

3. A foil-lid arrangement according to claim 2 in which said double ribs are spaced apart so that at least an axial end of said bead surface is located axially offset although substantially centrally therebetween, said double ribs consequently providing a broad area of contact sealing for said liner against said bead surface.

4. A foil-lid arrangement according to claim 1 in which said inner skirt portion has an inwardly projecting ridge that fits over said bead surface in an outer location thereof.

5. A foil-lid arrangement according to claim 4 in which said liner sealingly engages said bead surface axially and said projecting tabs engage radially thereof in substantially 120° arcuately spaced locations relative to each other.

6. A foil-lid arrangement according to claim 3 in which said foil-membrane liner is mechanically secured both centrally to one side of said lid body and also in radially outwardly concentrically spaced relation thereto substantially axially between said axial end of said bead surface and said double ribs.

7. A foil-lid arrangement according to claim 4 in which said inner skirt portion is axially shorter than said outer skirt portion.

8. A foil-lid arrangement according to claim 7 in which said projecting tabs span angularly beyond the slit space open in only one direction below said outer and inner skirt portions.

9. A foil-lid arrangement according to claim 4 in which outer periphery of said foil-member liner is approximately the same as outer periphery of said container bead surface.

10. A foil-lid arrangement according to claim 3 in which ridges are provided extending axially centrally between the axial end of the bead surface and said spaced apart double ribs.

11. A foil-lid arrangement according to claim 1 wherein said liner is made of plastic and coated adhesive bonds to one side thereof.

12. A foil-lid arrangement according to claim 1 wherein said liner is made of paper and coated adhesive bonds to one side thereof.

13. A foil-lid arrangement according to claim 1 wherein said liner is metallic and coated adhesive bonds to one side thereof.

14. A foil-lid arrangement according to claim 1 wherein said liner is non-metallic and coated adhesive bonds to one side thereof.

15. A foil-lid arrangement according to claim 1 wherein said liner is a laminate and coated adhesive bonds to one side thereof.

* * * * *